United States Patent [19]

Montiel

[11] Patent Number: 4,530,726

[45] Date of Patent: Jul. 23, 1985

[54] FINGERNAIL REFINISHING PRODUCT AND METHOD

[76] Inventor: Alexandra Montiel, 639 Bushwick Ave., Brooklyn, N.Y. 11206

[21] Appl. No.: 481,736

[22] Filed: Apr. 4, 1983

Related U.S. Application Data

[63] Continuation-in-part of Ser. No. 301,457, Sep. 14, 1981, abandoned.

[51] Int. Cl.[3] ..... B08B 7/00; A45D 29/00; A61K 7/04

[52] U.S. Cl. ..... 134/6; 132/73.5; 134/38; 252/555; 424/61

[58] Field of Search ..... 134/4, 6, 38; 252/DIG. 5, 90, 91, 555, 163, 164; 424/61; 206/210; 132/73, 73.5, 75; 15/104.92, 104.93, 104.94; 427/322, 323; 106/11

[56] References Cited

U.S. PATENT DOCUMENTS 3,150,048 9/1964 Hollub ..... 252/163 X
4,282,891 8/1981 Duceppe ..... 132/73.5

FOREIGN PATENT DOCUMENTS 122013 7/1982 Japan ..... 424/61
WO82/00122 12/1982 PCT Int'l Appl. ..... 132/73

*Primary Examiner*—S. Leon Bashore
*Assistant Examiner*—K. M. Hastings
*Attorney, Agent, or Firm*—Nathaniel Altman

[57] ABSTRACT

A fingernail refinishing product and method for dissolving and removing old lacquer nail polish, for softening and conditioning fingernails, cuticles and surrounding skin, and for depositing a clear nail-strengthening priming coat, all simultaneously, in preparation for the application of fresh nail polish. The product comprises a spill-proof applicator in the form of a reclosable container filled with a slitted sponge saturated with a water-miscible liquid composition which contains solvents, film-forming and nail-strengthening ingredients, and substantial amounts (up to 25% by weight) of an emollient-emulsifier-cleaner formed by the sulfonation reaction of the ricinoleic acid in castor oil. The three-function fingertip treatment—polish removal, conditioning, and nail prime-coating—takes place inside the applicator and is accomplished by the insertion of each fingertip, at least one at a time, into contact with the liquid saturated sponge.

20 Claims, 5 Drawing Figures

FINGERNAIL REFINISHING PRODUCT AND METHOD

BACKGROUND OF THE INVENTION

This application is a continuation-in-part of prior application Ser. No. 06/301,457, filed 09/14/81, now abandoned.

A wide variety of fingernail lacquer polish removers is known or is now in use. These products range from conventional solvents (acetone, alkyl acetates, etc.) to cream, pastes and gels containing emollients, humectants, surface-active agents and the like. The prior art, reflecting the spectrum of preparations for this purpose, includes the following:

| | |
|---|---|
| U.S. Pat. No. 1,878,102 Bradley | Sept. 20, 1932 |
| U.S. Pat. No. 2,032,042 Bishop | |
| U.S. Pat. No. 2,393,864 Francisco | Jan. 29, 1946 |
| U.S. Pat. No. 2,971,920 Wurmbock et al | Feb. 14, 1961 |
| U.S. Pat. No. 3,150,048 Hollub et al | Sep. 22, 1964 |
| U.S. Pat. No. 4,032,464 Mausner | June 28, 1977 |

A second group of products now available, designed to condition and strengthen the finger nails, includes liquids and creams containing proteinaceous materials, humectants, emollients, etc.; and a third type of preparation, providing a prime strengthening coat for the nails, with film-forming ingredients such as cellulose derivatives, acrylic and vinyl resins, is being sold.

However, no preparation described in the prior art, or now available, is capable of combining all the functions of the three product groups described above into an effective one-step treatment of the fingernails, cuticles and adjacent fingertip skin. Such a combination treating composition, representing one facet and one principal object of the present invention, should, in a single application by fingertip dipping, accomplish the following; (1) loosen and dissolve old nail polish and disperse any solid residue (pigments, dirt, etc.); (2) clean, condition and soften nails, cuticles and surrounding skin; (3) leave a clear nail-strengthening flexible priming coat on the fingernails, in preparation for a fresh nail polish finish coat; and (4) leave cuticles and surrounding skin soft, smooth and free of any film or residue after rinsing with water.

Conventional prior art products cannot be adapted or combined to meet these requirements. The polish removers of the first group, and the nail-strengthers of the second, use emollients such as animal and vegetable oils, waxes, fatty acid esters and ethers, poly glycols and the like, or incorporate thickening agents such as natural gums, cellulose compounds, and finely divided $SiO_2$; while the prime coating compositions include acrylic and vinyl resins, cellulose derivatives. Combination products containing any of these ingredients, if applied to the skin, would leave objectionable residues, whether oily, waxy, gummy, sticky or filmy, which would require washing, scrubbing or at least rubbing to remove from the fingertips.

Virtually all the prior art products, supplied in liquid or cream form, are intended to be applied by brushing or swabbing them on and off again to remove old polish and excess treating material. This procedure can be time-consuming and messy, with the hazards of dripping or spilling constantly present. A second facet and another principal object of this invention is to provide an improved and novel applicator and method for using the multipurpose liquid composition described, thus overcoming the difficulties and disadvantages of the prior art.

SUMMARY OF THE INVENTION

A fingernail refinishing product and method for dissolving and removing old lacquer nail polish, for cleaning, softening and conditioning fingernails, cuticles and surrounding skin, and for depositing a clear flexible nail-strengthening primary coat, all simultaneously in preparation for the application of fresh nail polish, is disclosed. The product comprises a spill-proof applicator in the form of a reclosable container substantially filled with a synthetic foam sponge saturated with fingertip-treating liquid.

The sponge may have vertically extending slits to permit easy introduction of one or more fingertups at a time for treatment by contact with the saturated sponge; one embodiment of the invention provides a circumferential slit near and following the periphery of the sponge to accept all five fingertips of one hand for simultaneous treatment.

The liquid composition of this invention in its preferred form includes: a mixture of ethyl acetate and isopropyl alcohol as solvents; substantial amounts (up to 25% by weight) of a hydrophilic reaction product of sulfuric acid and castor oil, the ricinoleic acid content of which having been converted into a buffered sulfonate derivative; a natural protein for strengthening the nails and the priming coat; nitrocellulose acetate and clear liquid nylon as film-forming prime coat elements; and fragrance as desired.

The key ingredient of this composition, the sulfuric acid-castor oil reaction product, serves as emollient, polish remover, detergent cleaner, dispersing agent, emulsifier, and as plasticizing component in the priming coat formed on the fingernails by contact treatment with the liquid composition.

It has previously been unrecognized that a sulfonated hydrophilic derivative of castor oil retains all the outstanding emollient, softening and plasticizing characteristics of the original oil, without its oily properties. At the same time, this component derived from castor oil, when used in the generous proportions of 10% by weight or more, demonstrates excellent polish-removing, detergent cleaning, dispersing, emulsifying, plasticizing and stabilizing qualities.

To practise the novel method of fingernail refinishing, using the product of this invention, the fingertips are inserted, at least one at a time, into the opened container of the applicator where the treatment takes place on the fingertips, in frictional contact with slits of the synthetic plastic foam sponge saturated with the treating liquid. As the fingertips, free of old polish and dirt and with nails, cuticles and surrounding skin conditioned, are withdrawn from the applicator, the prime coating deposited on the nails dries almost instantly, then nails may be coated at once with a conventional polish in the conventional manner and allowed to dry. Finally, rinsing of the fingertips with water leaves them soft, smooth, clean and free of film or residue.

The best mode for practising the present invention now contemplated will be described in full detail in connection with the accompanying drawings, wherein:

DRAWINGS

DESCRIPTION OF THE PREFERRED EMBODIMENTS

Figure 1:
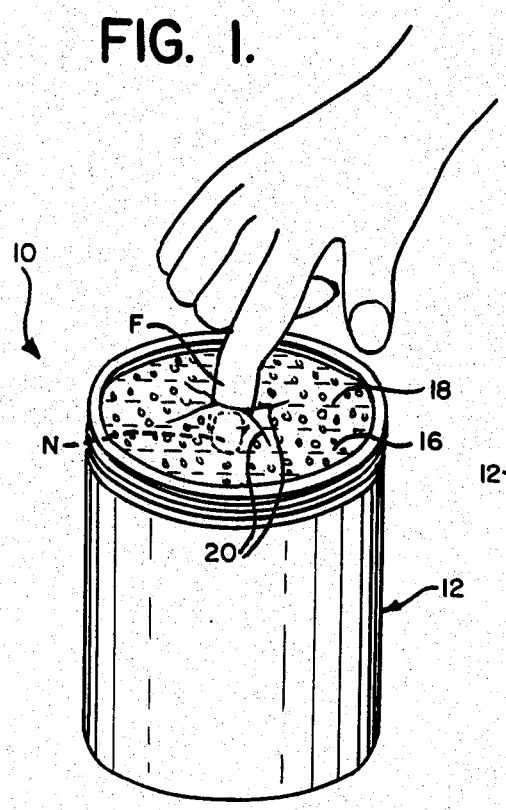
FIG. 1 is a perspective view showing a preferred form of the applicator of this invention in use.
Figure 2:
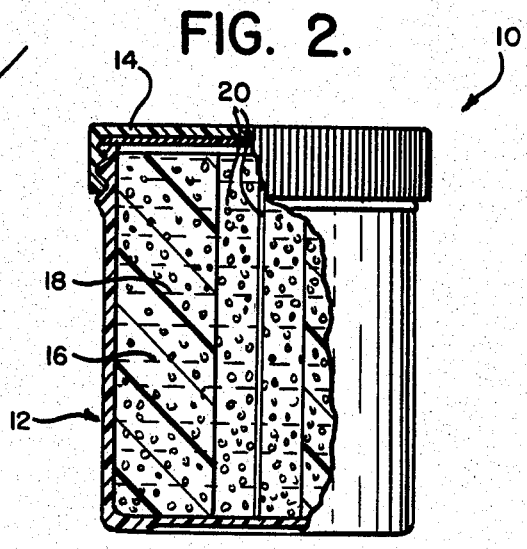
FIG. 2 is an elevational view, partially broken away, of the closed applicator of FIG. 1.
Figure 3:
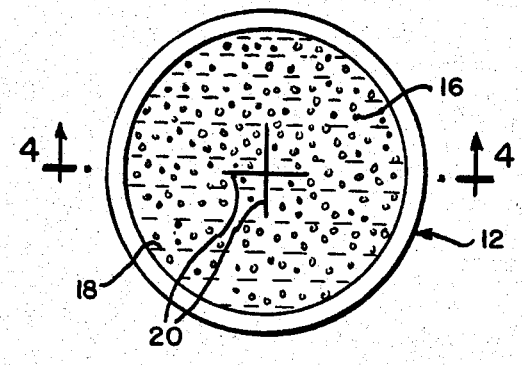
FIG. 3 is a top plan view of the applicator of FIG. 2 with its cover removed.
Figure 4:
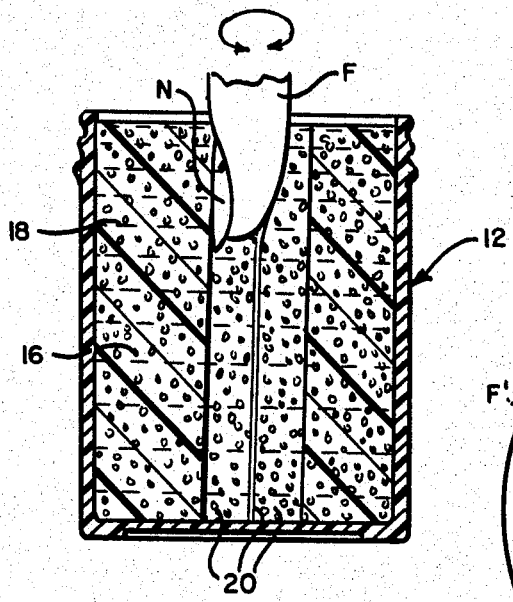
FIG. 4 is a sectional view taken along line 4—4 of FIG. 3, with a fingertip inserted for treatment.

FIGS. 1–4 illustrate one preferred form of the novel fingernail refinishing product, generally designated 10, with container 12 and tightly fitting screw cap cover 14 (FIG. 2). Container 12, here shown as a cylindrical plastic jar, obviously may be made of other suitable materials and formed in any convenient shape.

Synthetic plastic foam sponge 16, saturated with fingertip treating liquid 18 as shown, is dimensioned substantially to fill, and to be held unslippably within, container 12. As a result of the fit of sponge 16 in container 12 and the consistency of saturating liquid 18, opened container 12 may be upset inadvertently or even deliberately inverted without dislodging sponge 16 or spilling liquid 18. Sponge 16 is provided with centrally disposed cross-slits 20 to facilitate insertion of a fingertip F to be treated and to insure good contact between the fingernail N and a surface of sponge 16. While any synthetic plastic foam sponge not affected by the solvents in fingernail treating liquid 18 may be used, the preferred sponge 16 is a fine-grained hybrid polyurethane with a density of 2.2 pounds per cubic foot.

To use product 10, each fingertip F, in turn or in groups, is inserted into slits 20, held for a few seconds, then rotated slightly. Gentle friction against sponge 16, constantly wet by its own wicking action, permits liquid 18 to dissolve the old nailpolish (coloring pigments in the old polish settle down through sponge 18 to the bottom of container 12 and do not interfere with subsequent nail treatments). As each treated fingertip F is removed, it dries almost instantly with a clear priming coat deposited on the nail. Then a finish coat of fresh nail polish may be applied directly to treated nails N and allowed to dry. Rinsing the fingertips thereafter reveals a soft, smooth, clean feel to the treated skin and cuticles around the fingernails, with no residue, stickiness or gumminess.

Figure 5:
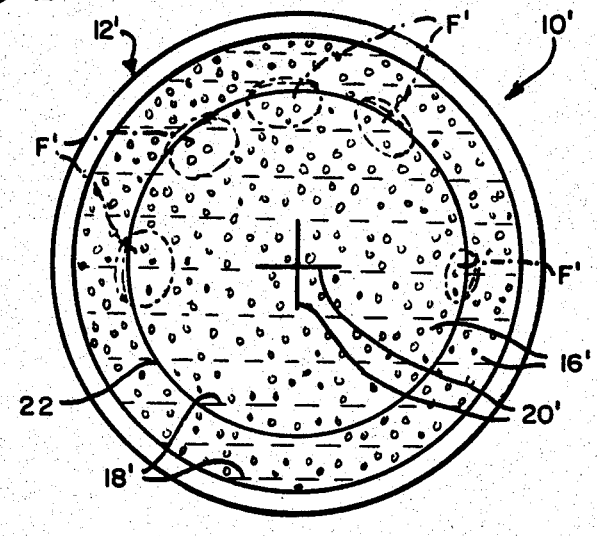
FIG. 5 is a top plan view of a second embodiment of this invention, the applicator being shown with its cover removed.

FIG. 5 illustrates another embodiment of the invention, wherein product 10' has a container 12', sponge 16', remover-conditioner-primer liquid 18' and centrally disposed cross-slit 20'. In addition, a circumferential slit 22 is provided near the periphery of sponge 16' to permit the simultaneous insertion and treatment of all five fingertips F' of one hand.

Fingertip-treating liquids 18, 18' in their preferred form are formulated as follows:

| | |
|---|---|
| Ethyl Acetate | 30 parts by weight |
| Isopropyl Alcohol | 30 parts by weight |
| Castor Oil 50* | 15 parts by weight |
| Cascaloid ST 62** | 1 part by weight |
| Nitrocellulose Acetate*** | 1 part by weight |
| Clear liquid nylon*** | ¾ part by weight |

-continued

| | |
|---|---|
| Fragrance | 0.1 part by weight |

*Castor Oil 50 is a reaction product of castor oil and sulfuric acid, with the natural ricinoleic acid, $CH_3(CH_2)_5CHOHCH_2CH{=}CH(CH_2)_7COOH$, of the castor oil having been converted into a buffered sulfonate derivative:

$$CH_3(CH_2)_5\underset{\underset{OSO_2OH}{|}}{C}HCH_2CH{=}CH(CH_2)_7COOH.$$

The resultant compound contributes to the liquid composition of this invention the following essential functions; as detergent cleaner assisting the solvents in rapidly dissolving old nail polish and in dispersing polish pigments and dirt; as emulsifier for the other ingredients rendering this composition uniform, stable and thoroughly water-miscible; most importantly, as emollient for softening and conditioning fingernails, cuticles and surrounding skin; and as a plasticizing component in the nail-strengthening prime coating deposited on the fingernails by treatment with the liquid composition.

The heart of this invention is the suprising discovery that this sulfuric acid-castor oil product retains the outstanding emollient characteristics of castor oil itself and adds enhanced solvent activity to the liquid composition as well as plasticity to the prime coating formed on the fingernails. It also provides superior dispersing and emulsifying properties without the harmful nail- and skin-drying effects of conventional agents for this purpose, even though this sulfuric acid-castor oil reaction product is used in amounts of 10–25% by weight, while other emulsifiers dispersing and surface active agents are normally used in the range between 0.1 and 5%.

Castor Oil 50 is obtainable from Welch, Holme and Clark, 1000 South Fourth Street, Harrison, N.J. 07029.

**Cascoloid ST 62, containing natural protein, may be obtained from Roda, 51 Madison Ave., N.Y., N.Y. 10010. Obviously other proteinaceous products may be substituted to provide the nail-building and nail-strengthening effect desired.

***Both nitrocellulose acetate, in the form of a cotton-like fluff, and clear liquid nylon are primer coat film-formers, and both are obtainable from Union Carbide Corp., 270 Park Avenue, N.Y., N.Y. 10017.

It may be noted that while no water is added in the preparation of liquids 18,18', a significant water content exists in the final product, brought in by the isopropyl alcohol and Castor Oil 50. This formulation, completely stable and water-miscible, is extremely effective in its three functions of removing old nail polish, conditioning nails, cuticles and skin, and providing an excellent nail-strengthening primer coat base for fresh nail polish; in spill-proof applicators 10, 10', the complete product of this invention provides literally hundreds of easy, efficient nail refinishing treatments. In addition, it is contemplated to provide separate containers of liquid 18,18' as refills for applicators 10,10'.

Full details of the presently preferred embodiments of this invention have been disclosed. Variations are to be expected without departing from its basic concepts, the scope of which is defined by the ensuing claims.

What is claimed is:

1. Fingernail refinishing product for simultaneously removing fingernail polish, conditioning cuticles, fingernails and fingertips, and depositing a clear prime coat on fingernails, which comprises a fingertip-treating liquid composition contained within applicator means, said applicator means comprising:

a reclosable container dimensioned so that when said container is open, at least one fingertip at a time may be inserted for treatment therein; and porous resilient absorbent means, substantially filling said reclosable container, said absorbent means being saturated with said fingertip-treating liquid composition, said liquid composition comprising:

at least one solvent means for fingernail polish removal;

proteinaceous means for providing fingernail-strengthening qualities to said liquid composition;

at least one film-forming means for depositing a clear prime coating on the fingernails to be treated; and at least 10 weight percent of an emollient means consisting essentially of a reaction product of castor oil with sulfuric acid, the natural ricinoleic acid of said castor oil having been converted into a buffered sulfonate derivative.

2. The fingernail refinishing product of claim 1, wherein said porous resilient absorbent means is a synthetic plastic foam sponge shaped to fit unslippably within said reclosable container.

3. The fingernail refinishing product of claim 2, wherein said synthetic plastic foam sponge is made of hybrid polyurethane.

4. Fingernail refinishing product in accordance with claim 3, wherein said hybrid polyurethane sponge has a density in the range between 1.5 and 3 pounds per cubic foot.

5. Fingernail refinishing product in accordance with claim 2, wherein said synthetic plastic foam sponge has at least one centrally disposed slit extending vertically through said sponge for facilitating entry of, and wet-sponge-contact with, at least one fingertip to be treated.

6. Fingernail refinishing product in accordance with claim 2, wherein said synthetic plastic foam sponge has a pair of centrally disposed slits at right angles to one another, said slits extending vertically through said sponge.

7. Fingernail refinishing product in accordance with claim 2, wherein said sponge has a vertically extending slit positioned inwardly of, and following the periphery of, said sponge; said container and said sponge being dimensioned so that all five fingertips of one hand may be inserted into said vertically-extending, periphery-following slit for simultaneous treatment.

8. Fingernail refinishing product in accordance with claim 2, wherein said sponge, saturated with said fingertip-treating liquid composition, is dimensioned to fit within said reclosable container so that said container, when opened, may be inverted without said sponge falling out and without said liquid composition spilling.

9. Fingernail refinishing product in accordance with claim 2, further including said fingertip-treating liquid, without said applicator means, being packaged in a second separate container for use as a refill for said applicator means.

10. Fingernail refinishing product in accordance with claim 1, wherein said at least one solvent means comprises ethyl acetate and isopropyl alcohol.

11. Fingernail refinishing product in accordance with claim 1, wherein said at least one film-forming means comprises nitrocellulose acetate.

12. Fingernail refinishing product in accordance with claim 1, wherein said at least one film-forming means comprises clear liquid nylon.

13. Fingernail refinishing product in accordance with claim 1, wherein said at least one film-forming means comprises nitrocellulose acetate and clear liquid nylon.

14. Fingernail refinishing product in accordance with claim 1, wherein said fingertip-treating liquid composition further comprises:

said at least one solvent means comprising ethyl acetate in the range between 25–50% by weight and isopropyl alcohol in the range between 25–50% by weight;

said proteinaceous means in the range between 0.5–2–5% by weight;

said at least one film-forming means comprising nitrocellulose acetate in the range between 0.5–2.5% by weight and clear liquid nylon in the range between 0.25–2% by weight; and said emollient means in the range between 10–25% by weight.

15. A method of refinishing fingernails, using a product for simultaneously removing fingernail polish, conditioning cuticles, fingernails and fingertips, and depositing a clear prime coat on fingernails, the product being a fingertip-treating liquid composition contained within applicator means and comprising a reclosable container substantially filled with porous resilient absorbent means saturated with said liquid composition which includes solvent means, proteinaceous means, film-forming means and at least 10% by weight of an emollient means consisting essentially of a reaction product of castor oil with sulfuric acid, the natural ricinoleic acid of said castor oil having been converted into a buffered sulfonate derivative, the method comprising steps of:

placing at least one fingertip at a time inside the opened said container of said applicator means so that each fingertip is brought into contact with said porous resilient absorbant means saturated with said liquid composition, whereby the old fingernail polish is dissolved and each fingertip is moistened;

removing each fingertip from said applicator means, resulting in rapid drying of the fingertip and the formation of a clear strengthening priming coat on each fingernail;

applying a convential lacquer polish to each fingernail, and permitting said polish to dry; and rinsing the fingertips with water, leaving cuticles and surrounding treated skin soft, smooth and free of residue.

16. The fingernail refinishing method of claim 15, wherein said porous resilient absorbent means comprises a synthetic plastic foam sponge.

17. The fingernail refinishing method of claim 15, wherein said fingertip-treating liquid comprises:

said solvent means comprising ethyl acetate and isopropyl alcohol;

said proteinaceous means;

said film-forming means comprising nitrocellulose acetate and clear liquid nylon; and said emollient means in the range between 10–25% by weight.

18. Fingertip-treating liquid composition for simultaneously removing fingernail polish, conditioning cuticles, fingernails and fingertips, and depositing a clear prime coat on fingernails, which comprises:

at least one solvent means for fingernail polish removal;

proteinaceous means for providing fingernail-strengthening qualities to said liquid composition;

at least one film-forming means for depositing a clear prime coating on the fingernails to be treated; and at least 10% by weight of an emollient means consisting essentially of a reaction product of castor oil with sulfuric acid, the natural ricinoleic acid of said castor oil having been converted into a buffered sulfonate derivative, said emollient means having detergent and cleaning power to aid said solvent means in polish removal, dispersing power to remove solid residue and dirt, plasticizing power to combine with and enhance said film-forming means, and emulsifying power to render said liquid composition uniform, stable and water-miscible.

19. Fingertip-treating liquid composition in accordance with claim 18, which further comprises:

said at least one solvent means comprising ethyl acetate and isopropyl alcohol; and said at least one film-forming means comprising nitrocellulose acetate and clear liquid nylon.

20. Fingertip-treating liquid composition in accordance with claim 18, which further comprises:

said at least one solvent means comprising ethyl acetate in the range between 25–50% by weight of the total liquid composition, and isopropyl alcohol in the range between 25–50% by weight of the total fingertip-treating liquid composition;

said proteinaceous means in the range between 0.5–2.5% by weight of the total liquid composition;

said at least one film-forming means comprising nitrocellulose acetate in the range between 0.5–2.5% by weight of the total liquid composition, and clear liquid nylon in the range between 0.5–2.5% by weight of the total liquid composition, and said emollient means in the range between 10–25% by weight of the total liquid composition.

* * * * *